US012312650B2

(12) United States Patent
Nishida et al.

(10) Patent No.: US 12,312,650 B2
(45) Date of Patent: May 27, 2025

(54) FERRITIC STAINLESS STEEL SHEET AND METHOD FOR MANUFACTURING THE SAME

(71) Applicant: JFE STEEL CORPORATION, Tokyo (JP)

(72) Inventors: Shuji Nishida, Tokyo (JP); Masataka Yoshino, Tokyo (JP); Fagang Gao, Tokyo (JP); Hiroshi Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 805 days.

(21) Appl. No.: 17/442,411

(22) PCT Filed: Mar. 26, 2019

(86) PCT No.: PCT/JP2019/012676
§ 371 (c)(1),
(2) Date: Sep. 23, 2021

(87) PCT Pub. No.: WO2020/194484
PCT Pub. Date: Oct. 1, 2020

(65) Prior Publication Data

US 2022/0170129 A1 Jun. 2, 2022

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/48*** | (2006.01) |
| ***C22C 38/50*** | (2006.01) |

(52) U.S. Cl.
CPC ..... *C21D 9/46* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/48* (2013.01); *C22C 38/50* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 2015/0020933 | A1 | 1/2015 | Hamada et al. | |
| 2019/0106775 | A1 * | 4/2019 | Nishida | C22C 38/20 |
| 2020/0002779 | A1 * | 1/2020 | Yoshino | C22C 38/48 |

FOREIGN PATENT DOCUMENTS

| | | | | |
|---|---|---|---|---|
| CN | 103403205 | A | 11/2013 | |
| CN | 104093871 | A | 10/2014 | |
| CN | 105960476 | A | 9/2016 | |
| CN | 107208213 | A | 9/2017 | |
| EP | 2 295 615 | A1 | 3/2011 | |
| EP | 2 677 055 | A1 | 12/2013 | |
| EP | 3 103 889 | A1 | 12/2016 | |
| EP | 3 249 067 | A1 | 11/2017 | |
| EP | 3 428 292 | A1 | 1/2019 | |
| JP | 2005-314740 | A | 11/2005 | |
| JP | 2010-235995 | A | 10/2010 | |
| JP | 2011-246764 | A | 12/2011 | |
| JP | 2017-186665 | A | 10/2017 | |
| JP | 2019-019366 | A | 2/2019 | |
| KR | 20160076792 | A | 7/2016 | |
| TW | 201005105 | A | 2/2010 | |
| WO | 2009/107475 | A1 | 9/2009 | |
| WO | 2016/143486 | A1 | 9/2016 | |
| WO | 2017/135240 | A1 | 8/2017 | |
| WO | WO-2017169377 | A1 * | 10/2017 | C21D 6/004 |
| WO | WO-2018139207 | A1 * | 8/2018 | C21D 6/004 |

OTHER PUBLICATIONS

Oct. 26, 2020 Office Action issued in Taiwanese Patent Application No. 109105386.
Jul. 2, 2019 International Search Report issued in International Patent Application No. PCT/JP2019/012676.
May 5, 2022 Office Action issued in Chinese Patent Application No. 201980094691.7.
Mar. 13, 2023 Office Action issued in Korean Patent Application No. 2021-7030086.

* cited by examiner

*Primary Examiner* — Xiaowei Su
(74) *Attorney, Agent, or Firm* — Oliff PLC

(57) ABSTRACT

Attached are a marked-up copy of the originally filed specification and a clean substitute specification in accordance with 37 C.F.R. §§ 1.121(b)(3) and 1.125(c). The substitute specification contains no new matter.

19 Claims, No Drawings

FERRITIC STAINLESS STEEL SHEET AND METHOD FOR MANUFACTURING THE SAME

TECHNICAL FIELD

A ferritic stainless steel sheet of the present application is used in an environment where hydrogen is absorbed into steel and has excellent corrosion resistance and excellent hydrogen embrittlement resistance.

BACKGROUND

Stainless steels have excellent corrosion resistance because they contain Cr, which forms a dense and chemically stable passive film on the steel surface. Among stainless steels, ferritic stainless steels have been used for various applications including cooking utensils because they are relatively inexpensive since they do not contain many expensive elements in comparison with austenitic stainless steels, have a low coefficient of thermal expansion, and are magnetic.

When a general-purpose ferritic stainless steel is welded, the corrosion resistance of the weld zone deteriorates significantly. The significant deterioration in corrosion resistance in the weld zone is attributed to what is called a sensitization phenomenon, in which Cr, C, and N form Cr carbonitrides in the weld zone during cooling after welding to cause the local depletion of Cr around the resulting Cr carbonitrides.

To deal with this, among the ferritic stainless steels, ferritic stainless steels having reduced C and N contents and containing appropriate amounts of stabilizing elements typified by Ti and Nb are especially used in applications involving welding. This is because Ti and Nb form carbonitrides in preference to Cr in the weld zone after the welding, thereby preventing the formation of Cr carbonitrides and suppressing the sensitization phenomenon.

Nb is often used as a stabilizing element, especially from the viewpoint of its high affinity with C and N. However, Nb is an expensive additive element and also deteriorates the formability of the steel. Thus, Nb contained is partially replaced with Ti, in some cases. Such a ferritic stainless steel containing a combination of Nb and Ti (Nb—Ti-containing ferritic stainless steel) suppresses the sensitization phenomenon caused by welding. However, it has been found that the embrittlement of steel sheet when hydrogen is absorbed into the steel, i.e., hydrogen embrittlement, may occur. Examples of cases where hydrogen is absorbed into steel include cases of heat treatment in a hydrogen atmosphere, pickling, passivation treatment to improve corrosion resistance, and the occurrence of corrosion.

When hydrogen embrittlement occurs, cracking occurs easily during the working of the steel sheet. Additionally, cracking may also occur in a portion where residual stress has been generated in the steel sheet that has already been worked into a fabricated member. These events have been problems.

For this reason, there has been a need for a Nb—Ti-containing ferritic stainless steel that can suppress embrittlement even when hydrogen is absorbed into the steel sheet in an environment where hydrogen is absorbed thereinto, i.e., a Nb—Ti-containing ferritic stainless steel having excellent hydrogen embrittlement resistance. Thus, we aimed to develop a Nb—Ti-containing ferritic stainless steel sheet having excellent corrosion resistance and excellent hydrogen embrittlement resistance.

For example, Patent Literatures 1 and 2 disclose inventions on techniques for addressing hydrogen embrittlement in stainless steels.

Patent Literature 1 discloses a heat treatment method in which an austenitic stainless steel having an austenite phase whose crystal structure is a face-centered cubic lattice structure is heated to remove hydrogen present in the austenitic stainless steel.

Patent Literature 2 discloses a high-strength austenitic stainless steel having excellent hydrogen embrittlement resistance, the steel containing, by mass percent, C: 0.2% or less, Si: 0.3% to 1.5%, Mn: 7.0% to 11.0%, P: 0.06% or less, S: 0.008% or less, Ni: 5.0% to 10.0%, Cr: 14.0% to 20.0%, Cu: 1.0% to 5.0%, N: 0.01% to 0.4%, and O: 0.015% or less, the balance being Fe and incidental impurities, a Cr-based carbonitride having an average size of 100 nm or less, the Cr-based carbonitride being contained in an amount of 0.001% to 0.5% by mass.

CITATION LIST

Patent Literature

PTL 1: International Publication No. 2009/107475
PTL 2: International Publication No. 2016/143486

SUMMARY

Technical Problem

The technique disclosed in Patent Literature 1 is a technique that employs a method called dehydrogenation treatment, in which a steel sheet or worked product thereof is heat-treated at 200° C. to 1,100° C. to promote the release of hydrogen from the steel. However, this technique disadvantageously requires equipment for dehydrogenation and the implementation of heat treatment, leading to an increase in production costs. Thus, there is a need to establish a technique that does not require dehydrogenation treatment.

The technique disclosed in Patent Literature 2 has problems that large amounts of Ni and Cu, which are expensive elements, absolutely need to be contained and, moreover, a large amount of Mn absolutely needs to be contained in the steel, which greatly increases the production costs. Thus, there is a need to reduce the Ni content, the Cu content, and the Mn content.

The disclosed embodiments have been made in light of the foregoing problems and aims to provide a Nb—Ti-containing ferritic stainless steel sheet having excellent corrosion resistance and excellent hydrogen embrittlement resistance without requiring dehydrogenation treatment during its manufacture or incorporating large amounts of Ni, Cu, or Mn, and a method for manufacturing the same.

In the disclosed embodiments, "excellent corrosion resistance" indicates that the rusting area fraction, measured by the following method, is 30% or less.

A corrosion test to evaluate the rusting area fraction is performed in accordance with JASO M609-91. A test specimen is washed with water and then ultrasonically degreased in ethanol for 5 minutes. Subsequently, 15 cycles of the corrosion test are performed, one cycle consisting of salt spraying (5% by mass aqueous NaCl solution, 35° C.) for 2 hours→drying (60° C., relative humidity: 40%) for 4 hours→wetting (50° C., relative humidity: 95% or more) for 2 hours. After the test, the rusting area fraction is measured by image analysis for a 30 mm×30 mm region in the middle of the test specimen from a photograph of the test specimen.

"Excellent hydrogen embrittlement resistance" indicates that the amount of decrease in elongation after fracture of the steel sheet containing concentration of 0.30 to 0.60 mass ppm hydrogen is 5% or less of the elongation after fracture of a steel sheet having the same chemical composition as the steel sheet, manufactured under the same manufacturing conditions, and containing concentration of 0.02 mass ppm or less hydrogen. In other words, it indicates that the elongation after fracture A (%) of the steel sheet containing concentration of 0.30 to 0.60 mass ppm hydrogen and the elongation after fracture B (%) of the steel sheet containing concentration of 0.02 mass ppm or less hydrogen satisfy formula (1):

$$\text{Elongation after fracture } B\ (\%) - \text{elongation after fracture } A\ (\%) \leq 5(\%). \quad \text{formula (1)}$$

In the test to evaluate the hydrogen embrittlement resistance, four JIS No. 5 test specimens in accordance with JIS Z 2241 are first prepared from a steel sheet in such a manner that the longitudinal direction thereof is a direction perpendicular to the rolling direction.

A first test specimen (test specimen A1) is subjected to cathodic electrolysis treatment in a 1 N sulfuric aqueous solution containing 0.01 M of thiourea at 10 to 100 C/dm$^2$ to allow 0.30 to 0.60 mass ppm of hydrogen to be contained. The fact that the amount of hydrogen contained is a desired amount is confirmed as follows: A second test specimen (test specimen A2) is subjected to the same cathodic electrolysis treatment, then immediately cut into a 10 mm×30 mm piece, immersed in liquid nitrogen and stored, ultrasonically cleaned in ethanol for 5 minutes, and brought back to room temperature. Then the hydrogen concentration in the steel is measured by thermal desorption spectroscopy. The analysis of the hydrogen amount by thermal desorption spectroscopy is performed under the condition that the temperature is increased from room temperature to 300° C. at 200° C./hour. The test specimen A1 containing hydrogen is subjected to cathodic electrolysis treatment and then immediately immersed in liquid nitrogen and stored.

A third test specimen (test specimen B1) is subjected to heat treatment at 300° C. for 1 hour in an air atmosphere to release hydrogen from the test specimen. The fact that hydrogen has been released is confirmed as follows: A fourth test specimen (test specimen B2) is subjected to the same heat treatment, then immediately cut into a 10 mm×30 mm piece, immersed in liquid nitrogen and stored, ultrasonically cleaned in ethanol for 5 minutes, and brought back to room temperature. Then the hydrogen concentration contained in the test specimen is measured by thermal desorption spectroscopy to confirm the hydrogen concentration contained in the test specimen to be 0.02 mass ppm or less. The test specimen B1 that has released hydrogen is subjected to heat treatment and then immediately immersed in liquid nitrogen and stored.

After that, each of the test specimens (A1 and B1) described above is removed from liquid nitrogen, ultrasonically cleaned in ethanol for 5 minutes, then brought back to room temperature, and subjected to a tensile test in accordance with JIS Z 2241 to evaluate the elongation after fracture. The cross-head speed is 25 mm/min at a gauge length of 50 mm. The amount of decrease in elongation after fracture is calculated by subtracting the elongation after fracture A (%) of the test specimen A from the elongation after fracture B (%) of the test specimen B.

Solution to Problem

To address the above problems, the inventors have conducted studies on a Nb—Ti-containing ferritic stainless steel sheet having excellent corrosion resistance and excellent hydrogen embrittlement resistance without requiring dehydrogenation treatment during its manufacture or incorporating large amounts of Ni, Cu, or Mn and have found the following.

In the case where a Nb—Ti-containing ferritic stainless steel sheet has a chemical composition containing, by mass percent, C: 0.001% to 0.020%, Si: 0.10% to 0.60%, Mn: 0.10% to 0.60%, P: 0.040% or less, S: 0.030% or less, Al: 0.030% to 0.060%, Cr: 16.5% to 19.0%, Ti: 0.15% to 0.35%, Nb: 0.30% to 0.60%, Ni: 0.01% to 0.60%, O (oxygen): 0.0025% to 0.0050%, and N: 0.001% to 0.020%, the balance being Fe and incidental impurities, the number of precipitates with a cross-sectional area of 5.0 μm$^2$ or more being 300 or less in a 1-mm$^2$ region, and the precipitates with a cross-sectional area of 5.0 μm$^2$ or more having an average cross-sectional area of 20.0 μm$^2$ or less, the Nb—Ti-containing ferritic stainless steel sheet can have improved corrosion resistance and hydrogen embrittlement resistance.

The mechanism is considered, as described below.

In the steel of the Nb—Ti-containing ferritic stainless steel sheet, coarse precipitates containing NbC precipitated around TiN having nuclei composed of Al-containing oxide inclusions (Al-based oxide) precipitated during casting are present (hereinafter, also referred to as "composite precipitates").

When the steel sheet is worked, local strain is concentrated around the coarse composite precipitates. This local strain remains in the steel even after working. When hydrogen is contained in the steel sheet during working or is absorbed into the steel sheet after working, hydrogen concentrates in these locally strained areas to increase the local hydrogen concentrations, causing embrittlement and then cracking of the steel sheet.

Such hydrogen embrittlement can be suppressed by reducing the number of starting points for cracks. The starting points for cracks are the above-mentioned coarse composite precipitates. It is thus important to reduce the size of these coarse composite precipitates and the number of these relatively coarse composite precipitates.

The size and number of the coarse composite precipitates described above can be reduced by appropriately regulating the upper limits of the C content, the N content, the Ti content, and the Nb content in the steel and by incorporating appropriate amounts of Al and O (oxygen) in the steel.

During the solidification of steel containing Al and O, an Al-based oxide crystallizes in the steel. When the amounts of Al and O contained in the steel are in the appropriate ranges, the above Al-based oxide crystallizes in the steel in a finely dispersed form.

Moreover, in this case, when the solidification of the steel proceeds, TiN precipitates in a dispersed state around the Al-based oxide crystallized in a dispersed state. Thus, TiN is reduced in size, compared with the case where appropriate amounts of Al and O (oxygen) are not contained in the steel. Furthermore, in the case where the upper limits of the N content and the Ti content of the steel are regulated and where the steel sheet is manufactured under appropriate conditions, TiN is further reduced in size, and the number of relatively coarse TiN particles is reduced. The precipitation of NbC around TiN can be sufficiently suppressed by regulating the upper limits of the C content and the Nb content of the steel and by manufacturing the steel sheet under appropriate conditions. This reduces the size and number of the coarse composite precipitates described above to improve the hydrogen embrittlement resistance of the steel sheet.

The disclosed embodiments are based on the foregoing findings, and the constituent of the summary thereof will be described below.

[1] A ferritic stainless steel sheet has a chemical composition containing, by mass percent:

C: 0.001% to 0.020%,
Si: 0.10% to 0.60%,
Mn: 0.10% to 0.60%,
P: 0.040% or less,
S: 0.030% or less,
Al: 0.030% to 0.060%,
Cr: 16.5% to 19.0%,
Ti: 0.15% to 0.35%
Nb: 0.30% to 0.60%,
Ni: 0.01% to 0.60%,
O (oxygen): 0.0025% to 0.0050%, and
N: 0.001% to 0.020%, the balance being Fe and incidental impurities, in which the number of precipitates having a cross-sectional area of 5.0 $\mu m^2$ or more is 300 or less in a 1-$mm^2$ region, and the precipitates having a cross-sectional area of 5.0 $\mu m^2$ or more have an average cross-sectional area of 20.0 $\mu m^2$ or less.

[2] In the ferritic stainless steel sheet described in [1], the chemical composition further contains, by mass percent, one or two or more selected from:

Cu: 0.01% to 0.80%,
Co: 0.01% to 0.50%,
Mo: 0.01% to 1.00%,
W: 0.01% to 0.50%,
V: 0.01% to 0.50%, and
Zr: 0.01% to 0.50%.

[3] In the ferritic stainless steel sheet described in [1] or [2], the chemical composition further contains, by mass percent, one or two or more selected from:

B: 0.0003% to 0.0030%,
Mg: 0.0005% to 0.0100%,
Ca: 0.0003% to 0.0030%,
Y: 0.01% to 0.20%,
rare-earth metals (REMs): 0.01% to 0.10%,
Sn: 0.01% to 0.50%, and
Sb: 0.01% to 0.50%.

[4] In the ferritic stainless steel sheet described in any one of [1] to [3], the elongation after fracture A (%) of the steel sheet when the steel sheet contains concentration of 0.30 to 0.60 mass ppm hydrogen and the elongation after fracture B (%) of the steel sheet when the steel sheet contains concentration of 0.02 mass ppm or less hydrogen satisfy formula (1):

$$\text{Elongation after fracture } B\ (\%) - \text{elongation after fracture } A\ (\%) \leq 5(\%). \qquad \text{formula (1)}$$

[5] A method for manufacturing the ferritic stainless steel sheet described in any one of any one of [1] to [4], the method includes the steps of:

hot-rolling a steel slab having the chemical composition into a hot-rolled steel sheet;

annealing the hot-rolled steel sheet by holding the hot-rolled steel sheet at 940° C. or higher and 980° C. or lower for 5 to 180 seconds into a hot-rolled and annealed steel sheet;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

Advantageous Effects

According to the disclosed embodiments, it is possible to provide a Nb—Ti-containing ferritic stainless steel sheet having excellent corrosion resistance and excellent hydrogen embrittlement resistance without requiring dehydrogenation treatment during its manufacture or incorporating large amounts of Ni, Cu, or Mn, and a method for manufacturing the same.

DESCRIPTION OF EMBODIMENTS

The disclosed embodiments will be specifically described below.

Reasons for limiting the chemical composition in the disclosed embodiments and the form of precipitates present will be described below. The "%" of a component in a steel sheet refers to "% by mass" unless otherwise specified.

C: 0.001% to 0.020%

C is an element effective in enhancing the strength of steel. This effect is provided at a C content of 0.001% or more. However, a C content of more than 0.020% results in an increase in the hardness of the steel to deteriorate the formability and also results in a deterioration in corrosion resistance. Accordingly, the C content is 0.001% to 0.020%. Preferably, the C content is 0.004% or more. More preferably, the C content is 0.007% or more. Preferably, the C content is 0.015% or less. More preferably, the C content is 0.012% or less.

Si: 0.10% to 0.60%

Si is an element useful as a deoxidizing agent. This effect is provided at a Si content of 0.10% or more. However, a Si content of more than 0.60% results in an increase in the hardness of the steel to deteriorate the formability. Accordingly, the Si content is 0.10% to 0.60%. Preferably, the Si content is 0.15% or more. Preferably, the Si content is 0.25% or less.

Mn: 0.10% to 0.60%

Mn has a deoxidizing effect. This effect is provided at a Mn content of 0.10% or more. However, a Mn content of more than 0.60% results in the promotion of the precipitation and coarsening of MnS, and the MnS acts as the starting point of a corrosion pit to deteriorate the corrosion resistance. Accordingly, the Mn content is 0.10% to 0.60%. Preferably, the Mn content is 0.15% or more. Preferably, the Mn content is 0.30% or less.

P: 0.040% or Less

P is an element that deteriorates the corrosion resistance. Additionally, P segregates at crystal grain boundaries to deteriorate the hot workability. Accordingly, the P content is preferably minimized and 0.040% or less. Preferably, the P content is 0.030% or less.

S: 0.030% or Less

S forms MnS as a precipitate with Mn. The MnS acts as the starting point of a corrosion pit and a starting point of fracture to deteriorate the corrosion resistance. Accordingly, a lower S content is more desirable, and the S content is 0.030% or less. Preferably, the S content is 0.020% or less.

Al: 0.030% to 0.060%

Al crystallizes as oxide-based inclusions in the steel, and the inclusions act as nuclei for the precipitation of TiN during the solidification of the steel, thereby reducing the size of TiN to improve the hydrogen embrittlement resistance of the steel. This effect is provided at an Al content of 0.030% or more. However, at an Al content of more than 0.060%, the Al-based oxide inclusions crystallized during the solidification are increased in size and less likely to act as nuclei for the precipitation of TiN, thereby forming coarse TiN in the steel to deteriorate the hydrogen embrittlement resistance of the steel. Accordingly, the Al content is 0.030% to 0.060%. Preferably, the Al content is 0.040% or more. Preferably, the Al content is 0.050% or less.

Cr: 16.5% to 19.0%

Cr is an element that forms a passive film on a surface to improve the corrosion resistance. A Cr content of less than 16.5% does not result in sufficient corrosion resistance. A Cr content of more than 19.0% results in an increase in the hardness of the steel to deteriorate the formability. Accordingly, the Cr content is 16.5% to 19.0%. Preferably, the Cr content is 17.0% or more. More preferably, the Cr content is 17.3% or more. Even more preferably, the Cr content is 17.6% or more. Preferably, the Cr content is 18.5% or less. More preferably, the Cr content is 18.3% or less. Even more preferably, the Cr content is 18.1% or less.

Ti: 0.15% to 0.35%

Ti is an element that forms a carbonitride to fix C and N, thereby improving the corrosion resistance of the steel. This effect is provided at a Ti content of 0.15% or more. However, a Ti content of more than 0.35% results in the promotion of the formation of a coarse carbonitride and an increase in the amount of Ti dissolved and present in the steel, thereby increasing the hardness of the steel to deteriorate the hydrogen embrittlement resistance. Accordingly, the Ti content is 0.15% to 0.35%. Preferably, the Ti content is 0.20% or more. Preferably, the Ti content is 0.30% or less.

Nb: 0.30% to 0.60%

Nb is an element that forms a carbonitride to fix C and N, thereby improving the corrosion resistance of the steel. This effect is provided at a Nb content of 0.30% or more. However, a Nb content of more than 0.60% results in the promotion of the formation of a coarse carbonitride and an increase in the amount of Nb dissolved and present in the steel, thereby increasing the hardness of the steel to deteriorate the hydrogen embrittlement resistance. Accordingly, the Nb content is 0.30% to 0.60%. Preferably, the Nb content is 0.35% or more. More preferably, the Nb content is 0.38% or more. Even more preferably, the Nb content is 0.40% or more. The Nb content is 0.55% or less. More preferably, the Nb content is 0.50% or less. Even more preferably, the Nb content is 0.45% or less.

Ni: 0.01% to 0.60%

Ni is an element that suppresses the active dissolution of the steel in a low pH environment. That is, Ni suppresses the progress of corrosion inside a corrosion pit formed on a surface of the steel sheet to suppress an increase in the depth of the corrosion pit. This effect is provided at a Ni content of 0.01% or more. However, a Ni content of more than 0.60% results in an increase in the hardness of the steel to deteriorate the formability. Accordingly, the Ni content is 0.01% to 0.60%. Preferably, the Ni content is 0.10% or more. Preferably, the Ni content is 0.25% or less.

O (Oxygen): 0.0025% to 0.0050%

O (oxygen) crystallizes as oxide-based inclusions with Al in the steel, and the inclusions act as nuclei for the precipitation of TiN during the solidification of the steel, thereby reducing the size of TiN to improve the hydrogen embrittlement resistance of the steel. This effect is provided at an Al content within the above range and an O content of 0.0025% or more. However, even if the Al content is within the above range, when the O content is more than 0.0050%, the oxide-based inclusions crystallized during the solidification are increased in size and less likely to act as nuclei for the precipitation of TiN, thereby forming coarse TiN in the steel to deteriorate the hydrogen embrittlement resistance of the steel. Accordingly, the Al content is within the above range, and the O content is 0.0025% to 0.0050%. Preferably, the O content is 0.0030% or more. Preferably, the O content is 0.0040% or less.

N: 0.001% to 0.020%

N is an element effective in enhancing the strength of the steel. This effect is provided at a N content of 0.001% or more. However, a N content of more than 0.020% results in an increase in the hardness of the steel to deteriorate the formability and a deterioration in corrosion resistance. Accordingly, the N content is 0.001% to 0.020%. Preferably, the N content is 0.003% or more. More preferably, the N content is 0.007% or more. Preferably, the N content is 0.015% or less. More preferably, the N content is 0.012% or less.

The balance, other than the above components, is Fe and incidental impurities.

In the disclosed embodiments, in addition to the above-mentioned components, one or two or more selected from Cu: 0.01% to 0.80%, Co: 0.01% to 0.50%, Mo: 0.01% to 1.00%, W: 0.01% to 0.50%, V: 0.01% to 0.50%, and Zr: 0.01% to 0.50% may be contained.

In the disclosed embodiments, moreover, one or two or more selected from B: 0.0003% to 0.0030%, Mg: 0.0005% to 0.0100%, Ca: 0.0003% to 0.0030%, Y: 0.01% to 0.20%, rare-earth metals (REMs): 0.01% to 0.10%, Sn: 0.01% to 0.50%, and Sb: 0.01% to 0.50% may be contained.

Cu: 0.01% to 0.80%

Cu is an element that strengthens a passive film to improve the corrosion resistance. At an excessively high Cu content, ε-Cu precipitates easily to deteriorate the corrosion resistance. Accordingly, when Cu is contained, the Cu content is 0.01% to 0.80%. Preferably, the Cu content is 0.30% or more. More preferably, the Cu content is 0.40% or more. Preferably, the Cu content is 0.50% or less. More preferably, the Cu content is 0.45% or less.

Co: 0.01% to 0.50%

Co is an element that improves the crevice corrosion resistance of stainless steel. An excessively high Co content results in an increase in the hardness of the steel to deteriorate the formability. Accordingly, when Co is contained, the Co content is 0.01% to 0.50%. Preferably, the Co content is 0.03% or more. More preferably, the Co content is 0.05% or more. Preferably, the Co content is 0.30% or less. More preferably, the Co content is 0.10% or less.

Mo: 0.01% to 1.00%

Mo is effective in improving the crevice corrosion resistance of stainless steel. An excessively high Mo content results in an increase in the hardness of the steel to deteriorate the formability. Accordingly, when Mo is contained, the Mo content is 0.01% to 1.00%. Preferably, the Mo content is 0.03% or more. More preferably, the Mo content is 0.05% or more. Preferably, the Mo content is 0.50% or less. More preferably, the Mo content is 0.30% or less.

W: 0.01% to 0.50%

W is an element that improves the crevice corrosion resistance of stainless steel. An excessively high W content results in an increase in the hardness of the steel to deteriorate the formability. Accordingly, when W is contained, the W content is 0.01% to 0.50%. Preferably, the W content is 0.03% or more. More preferably, the W content is 0.05% or more. Preferably, the W content is 0.30% or less. More preferably, the W content is 0.10% or less.

V: 0.01% to 0.50%

V is an element that forms a carbonitride to fix C and N, thereby improving the corrosion resistance of the steel. An excessively high V content results in excessive formation of carbonitride precipitates, which act as starting points of corrosion pits, thereby deteriorating the corrosion resistance of the steel. Accordingly, when V is contained, the V content is 0.01% to 0.50%. Preferably, the V content is 0.02% or more. More preferably, the V content is 0.03% or more. Preferably, the V content is 0.40% or less. More preferably, the V content is 0.30% or less.

Zr: 0.01% to 0.50%

Zr is an element that forms a carbonitride to fix C and N, thereby improving the corrosion resistance of the steel. An excessively high Zr content results in excessive formation of carbonitride precipitates, which act as starting points of corrosion pits, thereby deteriorating the corrosion resistance of the steel. Accordingly, when Zr is contained, the Zr content is 0.01% to 0.50%. Preferably, the Zr content is 0.02% or more. More preferably, the Zr content is 0.03% or more. Preferably, the Zr content is 0.40% or less. More preferably, the Zr content is 0.30% or less.

B: 0.0003% to 0.0030%

B is effective in improving the strength of steel. An excessively high B content results in an increase in the hardness of the steel to deteriorate the formability. Accordingly, when B is contained, the B content is 0.0003% to 0.0030%. Preferably, the B content is 0.0010% or more. Preferably, the B content is 0.0025% or less.

Mg: 0.0005% to 0.0100%

Mg forms a Mg oxide with Al in molten steel and acts as a deoxidizing agent. An excessively high Mg content results in an increase in the hardness of the steel to deteriorate the formability. Accordingly, when Mg is contained, the Mg content is 0.0005% to 0.0100%. Preferably, the Mg content is 0.0005% or more. More preferably, the Mg content is 0.0010% or more. Preferably, the Mg content is 0.0050% or less. More preferably, the Mg content is 0.0030% or less.

Ca: 0.0003% to 0.0030%

Ca forms an oxide in molten steel and acts as a deoxidizing agent. However, an excessively high Ca content results in an increase in the hardness of the steel to deteriorate the formability. Accordingly, when Ca is contained, the Ca content is 0.0003% to 0.0030%. Preferably, the Ca content is 0.0005% or more. More preferably, the Ca content is 0.0007% or more. Preferably, the Ca content is 0.0025% or less. More preferably, the Ca content is 0.0015% or less.

Y: 0.01% to 0.20%

Y is an element that reduces a reduction in the viscosity of molten steel to improve the cleanliness. An excessively high Y content results in an increase in the hardness of the steel to deteriorate the formability. Accordingly, when Y is contained, the Y content is 0.01% to 0.20%. Preferably, the Y content is 0.03% or more. Preferably, the Y content is 0.10% or less.

Rare-Earth Metals (REMs): 0.01% to 0.10%

Rare-earth metals (REMs: elements with atomic numbers 57 to 71, such as La, Ce, and Nd) are elements that reduce a reduction in the viscosity of molten steel to improve the cleanliness. When excessively large amount of REMs is contained, the steel is hardened to deteriorate the formability. Accordingly, when REMs are contained, the amount of REMs contained is 0.01% to 0.10%. Preferably, the amount of REMs contained is 0.02% or more. Preferably, the amount of REMs contained is 0.05% or less.

Sn: 0.01% to 0.50%

Sn is effective in promoting the formation of a deformation band during rolling to suppress surface deterioration due to working. An excessively high Sn content results in an increase in the hardness of the steel to deteriorate the formability. Accordingly, when Sn is contained, the Sn content is 0.01% to 0.50%. Preferably, the Sn content is 0.03% or more. Preferably, the Sn content is 0.20% or less.

Sb: 0.01% to 0.50%

As with Sn, Sb is effective in promoting the formation of a deformation band during rolling to suppress surface deterioration due to working. An excessively high Sb content results in an increase in the hardness of the steel to deteriorate the formability. Accordingly, when Sb is contained, the Sb content is 0.01% to 0.50%. Preferably, the Sb content is 0.03% or more. Preferably, the Sb content is 0.20% or less.

When Cu, Co, Mo, W, V, Zr, B, Mg, Ca, Y, rare-earth metals (REMS), Sn, and Sb, which are described above as optional components, are contained in amounts of less than the respective lower limits, these elements are considered to be contained as incidental impurities.

Number of Precipitates Having Cross-Sectional Area of 5.0 $\mu m^2$ or More (Coarse Precipitates) in 1-$mm^2$ Region: 300 or Less To achieve excellent hydrogen embrittlement resistance of the steel sheet, as coarse precipitates in the disclosed embodiments, the number of precipitates having a cross-sectional area of 5.0 $\mu m^2$ or more in a 1-$mm^2$ region of a cross section of the steel sheet needs to be 300 or less. In the case where the number of the precipitates is more than 300, when strain is applied to the steel containing hydrogen or when hydrogen is absorbed into the steel strained, hydrogen concentrates in the locally strained areas around the precipitates. This forms localized brittle regions in an excessively high density to lead to the embrittlement of the steel sheet. Thus, desired hydrogen embrittlement resistance is not provided.

The number of precipitates having a cross-sectional area of 5.0 $\mu m^2$ or more in a 1-$mm^2$ region of a cross section of the steel sheet is preferably 200 or less.

The number of precipitates having a cross-sectional area of 5.0 $\mu m^2$ or more in the 1-$mm^2$ region is measured as described below.

A C section of the resulting ferritic stainless steel sheet (a cross section of the steel sheet cut in a direction perpendicular to the rolling direction) is mirror-polished. Magnified images thereof are taken with an optical microscope (for example, DSX-510, available from Olympus Corporation) using a coaxial epi-illumination method, which is a typical optical microscopy. The images are taken using a 40× objective lens at a total magnification of 1,000× and subjected to piecing together in the 1-$mm^2$ region without changing the exposure time of each field of view. This shooting for the 1-$mm^2$ region is performed at 10 random locations. Here, the piecing together refers to a technique in which multiple adjacent fields of view are photographed in such a manner that a part of them overlap each other, and the captured images are pieced together to obtain an image of a wider area than a single field of view.

According to the above-mentioned imaging technique, a region of the matrix phase excluding the precipitates is imaged brightly, and portions of the precipitates are imaged darkly. Thus, on each of the resulting images, the region of the matrix phase excluding the precipitates has a high density (white), and precipitate portions have low densities (black).

The resulting captured images are image-processed by applying monochromatic and high-pass filters with image analysis software (for example, WinROOF2015, available from Mitani Corporation) to produce monochrome images with the background removed. Then the images are binarized in such a manner that the precipitate portions are extracted.

The high-pass filter removes frequency components having wavelengths of 70 μm or more.

The binarization of the images is performed by applying the following method to each of the images obtained by shooting the 1-$mm^2$ regions.

For one of the images to which the monochromatic and high-pass filters described above have been applied, the average density (A) of all pixels in the entire image, i.e., the measurement area, and the standard deviation (S) of the densities of all pixels are measured. Each pixel (also referred to as a picture element) is the smallest unit of an image that is handled by image analysis software, and each pixel has density information. A value obtained by subtracting the measured standard deviation multiplied by 3 from the measured average value (A−3×S) is defined as a threshold value for binarization of the image. The density of pixels having densities below the resulting threshold value is converted into "0", and the density of pixels having densities above the resulting threshold value is converted into "1", thereby completing the binarization of the image.

Here, each pixel having a density of "0" is regarded as one pixel included in the precipitate portions. When multiple pixels each having a density of "0" are adjacent to each other, a region formed of these adjacent pixels is regarded as a single precipitate portion.

The number of pixels constituting each precipitate portion is measured from each of the resulting binary image. The cross-sectional area of each precipitate portion is measured by multiplying the resulting number of pixels of each precipitate portion by the area of one pixel. The number of precipitates having a cross-sectional area of 5.0 $\mu m^2$ or more in each 1-$mm^2$ region is determined. The number of precipitates in all 10 areas is averaged to obtain the number of coarse precipitates having a cross-sectional area of 5.0 $\mu m^2$ or more in the 1-$mm^2$ region of the cross section of the steel sheet.

Average Cross-Sectional Area of Precipitates Having Cross-Sectional Area of 5.0 $\mu m^2$ or More: 20.0 $\mu m^2$ or Less To achieve excellent hydrogen embrittlement resistance of the steel sheet, the precipitates having a cross-sectional area of 5.0 $\mu m^2$ or more, which can be called coarse precipitates, need to have an average cross-sectional area of 20.0 $\mu m^2$ or less. In the case where the average cross-sectional area is more than 20.0 $\mu m^2$, when strain is applied to the steel containing hydrogen or when hydrogen is absorbed into the steel strained, hydrogen concentrates in the locally strained areas around the coarse precipitates. The concentrated portions act as starting points for cracks, thus failing to obtain a desired hydrogen embrittlement resistance. The precipitates having a cross-sectional area of 5.0 $\mu m^2$ or more preferably have an average cross-sectional area of 15.0 $\mu m^2$ or less.

The above average cross-sectional area is measured as described below.

From each binary image obtained in the evaluation of the number of the coarse precipitates described above, the cross-sectional area of each precipitate having a cross-sectional area of 5.0 $\mu m^2$ or more among the precipitates in each 1-$mm^2$ region is determined using the image analysis software described above. The cross-sectional areas of the precipitates in all 10 areas are averaged. The average cross-sectional area of the coarse precipitates (="the total cross-sectional area of the precipitates having a cross-sectional area of 5.0 $\mu m^2$ or more"/"the number of the precipitates having a cross-sectional area of 5.0 $\mu m^2$ or more") is determined.

A suitable method for manufacturing the ferritic stainless steel sheet of the disclosed embodiments will be described below. The steel having the above chemical composition is obtained by steelmaking using a known method with, for example, a converter or an electric furnace. The O (oxygen) concentration in the steel is adjusted by a vacuum oxygen decarburization (VOD) process. Then a steel material is made by a continuous casting process or an ingot casting-slabbing process. This steel material is heated at a temperature of 1,100° C. to 1,200° C. for 30 minutes or more and 2 hours or less, and then hot-rolled to a thickness of 2.0 to 5.0 mm. The resulting hot-rolled steel sheet is held in a temperature range of 940° C. to 980° C. for 5 to 180 seconds in an air atmosphere to produce a hot-rolled and annealed steel sheet. Then pickling is performed to remove the scale. Next, the sheet is cold-rolled and held in a temperature range of 1,000° C. to 1,060° C. for 5 to 180 seconds to produce a cold-rolled and annealed steel sheet. The cold-rolled steel sheet that has been annealed is then subjected to pickling or surface grinding to remove the scale. The descaled cold-rolled steel sheet may be subjected to skin-pass rolling.

The dissolution and precipitation behavior in the suitable manufacturing method will be described below.

A steel having a relatively low Si content and a relatively low Al content, Si and Al being elements that contribute to deoxidation, and having an appropriately controlled O content is produced by an advanced refining process typified by the VOD process and then cast, so that Al-containing oxide-based inclusions are crystallized in a dispersed state in the steel. With the progress of casting, a steel slab can be produced in which TiN is precipitated in a dispersed state using these inclusions as nuclei and NbC is precipitated around TiN.

The heating of the steel slab prior to hot rolling allows TiN and NbC to dissolve into the steel, so that the TiN precipitates are reduced in size, and most of the NbC precipitates disappear. In the hot-rolled steel sheet obtained after hot rolling, thus, most of the Ti, N, Nb, and C dissolved in the steel at the slab heating stage remain dissolved in the steel.

Then, the hot-rolled steel sheet is annealed at a temperature of 940° C. or higher and 980° C. or lower to soften the steel sheet with the growth of TiN suppressed, to the extent that the rolling load is not excessive in the subsequent cold rolling. However, NbC is precipitated around TiN during this annealing. After the cold rolling, the cold-rolled steel sheet is annealed at a temperature of 1,000° C. or higher and 1,060° C. or lower, thereby allowing most of the NbC precipitates to dissolve in the steel.

The above-mentioned process reduces the size and number of relatively coarse precipitates in the steel.

Step of Annealing Hot-Rolled Steel Sheet by Holding Hot-Rolled Steel Sheet at 940° C. or Higher and 980° C. or Lower for 5 to 180 Seconds into Hot-Rolled and Annealed Steel Sheet When the annealing temperature of the hot-rolled steel sheet is lower than 940° C., the steel is not sufficiently softened to lead to an excessive rolling load in the subsequent cold rolling step, thus easily causing the formation of surface defects of the steel sheet. When the annealing temperature of the hot-rolled steel sheet is higher than 980° C., the growth of TiN is promoted to excessively increase the number of coarse precipitates.

When the annealing time of the hot-rolled steel sheet is less than 5 seconds, the steel is not sufficiently softened to lead to an excessive rolling load in the subsequent cold rolling step, thus easily causing the formation of surface defects of the steel sheet. When the annealing time of the hot-rolled steel sheet is more than 180 seconds, some of the TiN precipitates grow to form particularly coarse precipitates in preference to others, thereby increasing the average cross-sectional area of the coarse precipitates. Accordingly, in the disclosed embodiments, preferably, the hot-rolled steel sheet is annealed by holding the hot-rolled steel sheet at 940° C. or higher and 980° C. or lower for 5 to 180 seconds into a hot-rolled and annealed steel sheet. More preferably, the annealing temperature of the hot-rolled steel sheet is in the range of 940° C. to 960° C.

The holding time described above is more preferably 10 seconds or more. The holding time described above is more preferably 60 seconds or less.

Step of Annealing Cold-Rolled Steel Sheet by Holding Cold-Rolled Steel Sheet at 1,000° C. or Higher and 1,060° C. or Lower for 5 to 180 Seconds When the annealing temperature of the cold-rolled steel sheet is lower than 1,000° C., NbC precipitated in large amounts around some coarse TiN in the step of annealing the hot-rolled steel sheet does not sufficiently dissolve in the steel, thereby increasing the average cross-sectional area of the coarse precipitates. When the annealing temperature of the cold-rolled steel sheet is higher than 1,060° C., the growth of TiN is promoted to excessively increase the number of the coarse precipitates.

When the annealing time of the cold-rolled steel sheet is less than 5 seconds, NbC precipitated in large amounts around some coarse TiN in the step of annealing the hot-rolled steel sheet does not sufficiently dissolve in the steel, thereby increasing the average cross-sectional area of the coarse precipitates. When the annealing time of the cold-rolled steel sheet is more than 180 seconds, the growth of TiN is promoted to excessively increase the number of the coarse precipitates.

Accordingly, in the disclosed embodiments, preferably, the cold-rolled steel sheet is annealed by holding the cold-rolled steel sheet at 1,000° C. or higher and 1,060° C. or lower for 5 to 180 seconds. More preferably, the annealing temperature of the cold-rolled steel sheet is in the range of 1,030° C. or higher and 1,060° C. or lower.

The holding time described above is more preferably 10 seconds or more. The holding time described above is more preferably 60 seconds or less.

EXAMPLES

Example 1

A ferritic stainless steel having the composition given in Table 1-1 was obtained by steelmaking, formed into a steel ingot weighing 100 kg, heated at 1,150° C. for 1 hour, and hot-rolled to a thickness of 3.0 mm. Immediately after the last pass of the hot rolling was completed, the hot-rolled steel sheet was naturally cooled.

TABLE 1-1

| Chemical composition (% by mass) | | | | | | | | | | | |
|---|---|---|---|---|---|---|---|---|---|---|---|
| C | Si | Mn | P | S | Al | Cr | Ti | Nb | Ni | O | N |
| 0.010 | 0.26 | 0.22 | 0.023 | 0.002 | 0.047 | 17.8 | 0.25 | 0.42 | 0.15 | 0.0032 | 0.009 |

* The balance other than the above chemical composition is Fe and incidental impurities.

The resulting hot-rolled steel sheets were held at the annealing temperatures for the respective hot-rolled steel sheets given in Table 1-2 for the annealing times for the respective hot-rolled steel sheets given in Table 1-2 and then naturally cooled to produce hot-rolled and annealed steel sheets.

The hot-rolled and annealed steel sheets were subjected to pickling with a sulfuric acid solution and then a mixed solution of hydrofluoric acid and nitric acid to produce materials for cold rolling. The materials were then cold-rolled to a thickness of 1.0 mm, thereby producing cold-rolled steel sheets.

The resulting cold-rolled steel sheets were held at the annealing temperatures for the respective cold-rolled steel sheets given in Table 1-2 for the annealing times for the respective cold-rolled steel sheets given in Table 1-2 and then naturally cooled. After that, the surface scale was removed by surface grinding of the front and back surfaces to obtain cold-rolled and annealed steel sheets.

The following evaluations were performed on the resulting cold-rolled and annealed steel sheets.

(1) Evaluation of Corrosion Resistance of Steel Sheet

Test specimens each measuring 80 mm long×60 mm wide were cut out by shearing from the cold-rolled and annealed ferritic stainless steel sheets made under the conditions of manufacture described above. After the cutting out, the surfaces were polished with emery paper up to 600 grit size and degreased with acetone. Then the corrosion resistance of the steel sheets was evaluated.

A corrosion test was performed in accordance with JASO M609-91. Each of the test specimens was washed with water and then ultrasonically degreased in ethanol for 5 minutes. Subsequently, 15 cycles of the corrosion test were performed, one cycle consisting of salt spraying (5% by mass aqueous NaCl solution, 35° C.) for 2 hours→drying (60° C., relative humidity: 40%) for 4 hours→wetting (50° C., relative humidity: 95% or more) for 2 hours. After the test, the rusting area fraction was measured by image analysis for a 30 mm×30 mm region in the middle of the test specimen from a photograph of the test specimen.

A steel sheet having a rust area fraction of 30% or less was evaluated as "○ (pass: outstanding)", and a steel sheet having a rust area fraction of more than 30% was evaluated as "▲ (fail)".

(2) Evaluation of Number of Coarse Precipitates

A C section of the resulting cold-rolled and annealed ferritic stainless steel sheet (a cross section of the steel sheet cut in a direction perpendicular to the rolling direction) was mirror-polished. Magnified images thereof were taken with an optical microscope (DSX-510, available from Olympus Corporation) using a coaxial epi-illumination method, which is a typical optical microscopy. The images were taken using a 40× objective lens at a total magnification of 1,000× and subjected to piecing together in the 1-$mm^2$ region without changing the exposure time of each field of view. This shooting for the 1-$mm^2$ region was performed at 10 random locations. Here, the piecing together refers to a technique in which multiple adjacent fields of view are photographed in such a manner that a part of them overlap each other, and the captured images are pieced together to obtain an image of a wider area than a single field of view.

According to the above-mentioned imaging technique, a region of the matrix phase excluding the precipitates is imaged brightly, and portions of the precipitates are imaged darkly. Thus, on each of the resulting images, the region of the matrix phase excluding the precipitates has a high density (white), and precipitate portions have low densities (black).

The resulting captured images were image-processed by applying monochromatic and high-pass filters with image analysis software (WinROOF2015, available from Mitani Corporation) to produce monochrome images with the background removed. Then the images were binarized in such a manner that the precipitate portions were extracted.

The high-pass filter removed frequency components having wavelengths of 70 μm or more.

The binarization of the images was performed by applying the following method to each of the images obtained by shooting the 1-$mm^2$ regions.

For one of the images to which the monochromatic and high-pass filters described above had been applied, the average density (A) of all pixels in the entire image, i.e., the measurement area, and the standard deviation (S) of the densities of all pixels were measured. Each pixel (also referred to as a picture element) is the smallest unit of an image that is handled by image analysis software, and each pixel has density information. A value obtained by subtracting the measured standard deviation multiplied by 3 from the measured average value (A−3×S) was defined as a threshold value for binarization of the image. The density of pixels having densities below the resulting threshold value was converted into "0", and the density of pixels having densities above the resulting threshold value was converted into "1", thereby completing the binarization of the image.

Here, each pixel having a density of "0" was regarded as one pixel included in the precipitate portions. When multiple pixels each having a density of "0" were adjacent to each other, a region formed of these adjacent pixels was regarded as a single precipitate portion.

The number of pixels constituting each precipitate portion was measured from each of the resulting binary image. The cross-sectional area of each precipitate portion was measured by multiplying the resulting number of pixels of each precipitate portion by the area of one pixel. The number of precipitates having a cross-sectional area of 5.0 $\mu m^2$ or more in each 1-$mm^2$ region was determined. The number of precipitates in all 10 areas was averaged to obtain the number of coarse precipitates having a cross-sectional area of 5.0 $\mu m^2$ or more in the 1-$mm^2$ region of the cross section of the steel sheet.

(3) Evaluation of Average Cross-Sectional Area of Coarse Precipitates

From each binary image obtained in the evaluation of the average number of the coarse precipitates described above, the cross-sectional area of each precipitate having a cross-sectional area of 5.0 $\mu m^2$ or more among the precipitates in each 1-$mm^2$ region was determined using the image analysis software described above. The cross-sectional areas of the precipitates in all 10 areas were averaged. The average cross-sectional area of the coarse precipitates was determined.

(4) Evaluation of Hydrogen Embrittlement Resistance

In a test to evaluate the hydrogen embrittlement resistance, four JIS No. 5 test specimens in accordance with JIS Z 2241 were first prepared from a steel sheet in such a manner that the longitudinal direction thereof was a direction perpendicular to the rolling direction.

A first test specimen (test specimen A1) was subjected to cathodic electrolysis treatment in a 1 N sulfuric aqueous solution containing 0.01 M of thiourea at 10 to 100 C/$dm^2$ to allow 0.30 to 0.60 mass ppm of hydrogen to be contained. The fact that the amount of hydrogen contained was a desired amount was confirmed as follows: A second test specimen (test specimen A2) was subjected to the same cathodic electrolysis treatment, then immediately cut into a 10 mm×30 mm piece, immersed in liquid nitrogen and stored, ultrasonically cleaned in ethanol for 5 minutes, and brought back to room temperature. Then the hydrogen concentration in the steel was measured by thermal desorption spectroscopy. The analysis of the hydrogen amount by thermal desorption spectroscopy was performed under the condition that the temperature was increased from room temperature to 300° C. at 200° C./hour. The test specimen A1 containing hydrogen was subjected to cathodic electrolysis treatment and then immediately immersed in liquid nitrogen and stored.

A third test specimen (test specimen B1) was subjected to heat treatment at 300° C. for 1 hour in an air atmosphere to release hydrogen from the test specimen. The fact that hydrogen had been released was confirmed as follows: A fourth test specimen (test specimen B2) was subjected to the same heat treatment, then immediately cut into a 10 mm×30 mm piece, immersed in liquid nitrogen and stored, ultrasonically cleaned in ethanol for 5 minutes, and brought back to room temperature. Then the hydrogen concentration contained in the test specimen was measured by thermal desorption spectroscopy to confirm the hydrogen concentration contained in the test specimen to be 0.02 mass ppm or less. The test specimen B1 that had released hydrogen was subjected to heat treatment and then immediately immersed in liquid nitrogen and stored.

After that, each of the test specimens (A1 and B1) described above was removed from liquid nitrogen, ultrasonically cleaned in ethanol for 5 minutes, then brought back to room temperature, and subjected to a tensile test in accordance with JIS Z 2241 to evaluate the elongation after fracture. The cross-head speed was 25 mm/min at a gauge length of 50 mm. The amount of decrease in elongation at break was calculated by subtracting the elongation after fracture A (%) of the test specimen A from the elongation after fracture B (%) of the test specimen B.

A steel sheet having an amount of decrease in elongation after fracture of 5% or less was evaluated as "○ (pass)", and a steel sheet having an amount of decrease in elongation after fracture of more than 5% was evaluated as "▲ (fail)".

Table 1-2 presents the results obtained.

TABLE 1-2

| Test No. | Annealing temperature of hot-rolled steel sheet (° C.) | Annealing time of hot-rolled steel sheet (s) | Annealing temperature of cold-rolled steel sheet (° C.) | Annealing time of cold-rolled steel sheet (s) | Number of coarse precipitates (pieces/mm$^2$) | Average cross-sectional area of coarse precipitates (μm$^2$) | Corrosion resistance | Hydrogen embrittlement resistance | Remarks |
|---|---|---|---|---|---|---|---|---|---|
| 1-1 | 940 | 30 | 1000 | 30 | 163 | 17.4 | ○ | ○ | Example |
| 1-2 | 940 | 10 | 1030 | 30 | 187 | 13.4 | ○ | ○ | Example |
| 1-3 | 940 | 30 | 1060 | 10 | 172 | 12.1 | ○ | ○ | Example |
| 1-4 | 960 | 8 | 1000 | 30 | 188 | 16.2 | ○ | ○ | Example |
| 1-5 | 960 | 50 | 1030 | 30 | 175 | 11.2 | ○ | ○ | Example |
| 1-6 | 960 | 30 | 1060 | 45 | 179 | 12.8 | ○ | ○ | Example |
| 1-7 | 980 | 150 | 1000 | 30 | 261 | 13.9 | ○ | ○ | Example |
| 1-8 | 980 | 30 | 1030 | 160 | 233 | 11.7 | ○ | ○ | Example |
| 1-9 | 980 | 30 | 1060 | 7 | 277 | 18.4 | ○ | ○ | Example |
| 1-10 | 1020 | 30 | 1000 | 30 | 335 | 17.2 | ○ | ▲ | Comparative example |
| 1-11 | 940 | 30 | 960 | 30 | 175 | 24.7 | ○ | ▲ | Comparative example |
| 1-12 | 960 | 30 | 1100 | 30 | 350 | 19.1 | ○ | ▲ | Comparative example |
| 1-13 | 960 | 600 | 1030 | 30 | 226 | 28.4 | ○ | ▲ | Comparative example |
| 1-14 | 960 | 30 | 1030 | 450 | 322 | 18.3 | ○ | ▲ | Comparative example |

* Underlined values are outside the range of the disclosed embodiments.

It was found that each of the steels of the disclosed embodiments (test Nos. 1-1 to 1-9) had excellent corrosion resistance and excellent hydrogen embrittlement resistance, in which the corrosion resistance was evaluated as "○", the average number of the coarse precipitates was 300 or less, the coarse precipitates had an average cross-sectional area of 20.0 μm$^2$ or less, and the hydrogen embrittlement resistance was evaluated as "○".

In the comparative example of test No. 1-10, the annealing temperature of the hot-rolled steel sheet was higher than the range of the disclosed embodiments, and the number of the coarse precipitates was larger than the range of the disclosed embodiments; thus, the hydrogen embrittlement resistance was poor.

In the comparative example of test No. 1-11, the annealing temperature of the cold-rolled steel sheet was lower than the range of the disclosed embodiments, and the average cross-sectional area of the coarse precipitates was larger than the range of the disclosed embodiments; thus, the hydrogen embrittlement resistance was poor.

In the comparative example of test No. 1-12, the annealing temperature of the cold-rolled steel sheet was higher than the range of the disclosed embodiments, and the number of the coarse precipitates was larger than the range of the disclosed embodiments; thus, the hydrogen embrittlement resistance was poor.

In the comparative example of test No. 1-13, the annealing time of the hot-rolled steel sheet was longer than the range of the disclosed embodiments, and the average cross-sectional area of the coarse precipitates was larger than the range of the disclosed embodiments; thus, the hydrogen embrittlement resistance was poor.

In the comparative example of test No. 1-14, the annealing time of the cold-rolled steel sheet was longer than the range of the disclosed embodiments, and the number of the coarse precipitates was larger than the range of the disclosed embodiments; thus, the hydrogen embrittlement resistance was poor.

Example 2

Ferritic stainless steels having compositions given in Table 2 were obtained by steel making, formed into steel ingots each weighing 100 kg, heated at 1,150° C. for 1 hour, and hot-rolled to a thickness of 3.0 mm. Immediately after the last pass of the hot rolling was completed, the hot-rolled steel sheets were naturally cooled.

The hot-rolled steel sheets were held at 940° C. for 10 seconds and then naturally cooled to produce hot-rolled and annealed steel sheets.

The hot-rolled and annealed steel sheets were subjected to pickling with a sulfuric acid solution and then a mixed solution of hydrofluoric acid and nitric acid to produce materials for cold rolling. The materials were then cold-rolled to a thickness of 1.0 mm, thereby producing cold-rolled steel sheets.

The resulting cold-rolled steel sheets were held at 1,040° C. for 45 seconds and then naturally cooled. After that, the surface scale was removed by surface grinding to obtain cold-rolled and annealed steel sheets.

The above-mentioned evaluations were performed on the resulting cold-rolled and annealed steel sheets.

Table 2 presents the results obtained.

TABLE 2

| Test | Chemical composition (% by mass) | | | | | | | | | | | | | Number of coarse precipitates | Average cross-sectional area of coarse precipitates | Corrosion | Hydrogen embrittlement | |
|---|---|---|---|---|---|---|---|---|---|---|---|---|---|---|---|---|---|---|
| No. | C | Si | Mn | P | S | Al | Cr | Ti | Nb | Ni | O | N | Other elements | (pieces/mm$^2$) | (μm$^2$) | resistance | resistance | Remarks |
| 2-1 | 0.009 | 0.25 | 0.25 | 0.028 | 0.003 | 0.048 | 16.9 | 0.24 | 0.41 | 0.17 | 0.0032 | 0.010 | — | 156 | 14.3 | ○ | ○ | Example |
| 2-2 | 0.010 | 0.21 | 0.25 | 0.023 | 0.002 | 0.042 | 17.8 | 0.25 | 0.42 | 0.19 | 0.0038 | 0.010 | — | 184 | 13.5 | ○ | ○ | Example |
| 2-3 | 0.008 | 0.23 | 0.28 | 0.024 | 0.002 | 0.043 | 18.8 | 0.27 | 0.45 | 0.17 | 0.0037 | 0.008 | — | 196 | 12.3 | ○ | ○ | Example |
| 2-4 | 0.011 | 0.24 | 0.18 | 0.029 | 0.002 | 0.041 | 17.6 | 0.17 | 0.44 | 0.18 | 0.0033 | 0.010 | — | 182 | 14.2 | ○ | ○ | Example |
| 2-5 | 0.011 | 0.20 | 0.19 | 0.027 | 0.004 | 0.045 | 17.8 | 0.33 | 0.43 | 0.18 | 0.0034 | 0.010 | — | 225 | 18.2 | ○ | ○ | Example |
| 2-6 | 0.019 | 0.11 | 0.58 | 0.028 | 0.004 | 0.043 | 17.7 | 0.28 | 0.42 | 0.17 | 0.0038 | 0.011 | — | 282 | 15.9 | ○ | ○ | Example |
| 2-7 | 0.010 | 0.20 | 0.24 | 0.025 | 0.003 | 0.033 | 17.8 | 0.25 | 0.40 | 0.59 | 0.0026 | 0.001 | — | 195 | 17.0 | ○ | ○ | Example |
| 2-8 | 0.002 | 0.24 | 0.12 | 0.024 | 0.002 | 0.057 | 17.7 | 0.24 | 0.42 | 0.13 | 0.0049 | 0.008 | — | 246 | 19.5 | ○ | ○ | Example |
| 2-9 | 0.012 | 0.55 | 0.29 | 0.025 | 0.002 | 0.047 | 17.8 | 0.26 | 0.43 | 0.03 | 0.0036 | 0.019 | — | 203 | 19.9 | ○ | ○ | Example |
| 2-10 | 0.009 | 0.22 | 0.28 | 0.025 | 0.001 | 0.044 | 17.8 | 0.26 | 0.31 | 0.19 | 0.0037 | 0.008 | — | 160 | 13.6 | ○ | ○ | Example |
| 2-11 | 0.011 | 0.24 | 0.28 | 0.027 | 0.003 | 0.043 | 17.6 | 0.28 | 0.58 | 0.21 | 0.0040 | 0.010 | — | 289 | 16.0 | ○ | ○ | Example |
| 2-12 | 0.007 | 0.25 | 0.24 | 0.021 | 0.003 | 0.048 | 17.8 | 0.25 | 0.44 | 0.13 | 0.0031 | 0.011 | Cu: 0.43 | 183 | 12.5 | ○ | ○ | Example |
| 2-13 | 0.010 | 0.21 | 0.15 | 0.025 | 0.004 | 0.049 | 17.8 | 0.20 | 0.44 | 0.20 | 0.0032 | 0.010 | B: 0.0015 | 154 | 15.0 | ○ | ○ | Example |
| 2-14 | 0.010 | 0.23 | 0.29 | 0.026 | 0.002 | 0.040 | 17.9 | 0.30 | 0.42 | 0.22 | 0.0033 | 0.009 | Co: 0.13, W: 0.22, V: 0.06 | 165 | 14.6 | ○ | ○ | Example |
| 2-15 | 0.010 | 0.22 | 0.16 | 0.028 | 0.002 | 0.047 | 17.7 | 0.28 | 0.42 | 0.13 | 0.0033 | 0.009 | Mo: 0.14, La: 0.08, Ca: 0.0020, Ce: 0.012 | 177 | 12.7 | ○ | ○ | Example |
| 2-16 | 0.007 | 0.25 | 0.28 | 0.023 | 0.002 | 0.043 | 18.1 | 0.20 | 0.40 | 0.15 | 0.0039 | 0.012 | Mo: 0.07, V: 0.15, Mg: 0.0032 | 190 | 12.1 | ○ | ○ | Example |
| 2-17 | 0.012 | 0.22 | 0.23 | 0.024 | 0.001 | 0.042 | 17.9 | 0.21 | 0.40 | 0.25 | 0.0038 | 0.012 | Cu: 0.15, Mo: 0.32, Zr: 0.06, Y: 0.03, Sn: 0.28, Sb: 0.27 | 163 | 10.1 | ○ | ○ | Example |
| 2-18 | 0.009 | 0.24 | 0.27 | 0.029 | 0.002 | 0.048 | 17.8 | 0.44 | 0.42 | 0.22 | 0.0033 | 0.010 | — | 356 | 21.7 | ○ | ▲ | Comparative example |
| 2-19 | 0.011 | 0.25 | 0.28 | 0.020 | 0.004 | 0.048 | 17.8 | 0.24 | 0.63 | 0.25 | 0.0037 | 0.010 | — | 277 | 22.5 | ○ | ▲ | Comparative example |
| 2-20 | 0.011 | 0.28 | 0.16 | 0.030 | 0.002 | 0.068 | 17.9 | 0.28 | 0.41 | 0.16 | 0.0031 | 0.008 | — | 438 | 18.6 | ○ | ▲ | Comparative example |
| 2-21 | 0.012 | 0.22 | 0.18 | 0.025 | 0.002 | 0.021 | 17.8 | 0.26 | 0.44 | 0.19 | 0.0036 | 0.009 | — | 254 | 23.4 | ○ | ▲ | Comparative example |
| 2-22 | 0.011 | 0.25 | 0.26 | 0.024 | 0.002 | 0.040 | 17.7 | 0.23 | 0.42 | 0.23 | 0.0061 | 0.011 | — | 391 | 19.1 | ○ | ▲ | Comparative example |
| 2-23 | 0.009 | 0.23 | 0.18 | 0.028 | 0.003 | 0.043 | 17.7 | 0.24 | 0.41 | 0.15 | 0.0022 | 0.011 | — | 286 | 23.7 | ○ | ▲ | Comparative example |
| 2-24 | 0.012 | 0.23 | 0.23 | 0.025 | 0.003 | 0.047 | 15.8 | 0.23 | 0.41 | 0.13 | 0.0030 | 0.011 | — | 154 | 13.8 | ▲ | ○ | Comparative example |

* Underlined values are outside the range of the disclosed embodiments.

* The balance other than the above chemical composition is Fe and incidental impurities.

It was found that each of the steels of the disclosed embodiments (test Nos. 2-1 to 2-17) had excellent corrosion resistance and excellent hydrogen embrittlement resistance, in which the corrosion resistance was evaluated as "○", the average number of the coarse precipitates was 300 or less, the coarse precipitates had an average cross-sectional area of 20.0 $\mu m^2$ or less, and the hydrogen embrittlement resistance was evaluated as "○".

In the comparative example of test No. 2-18, because the Ti content was higher than the composition range of the disclosed embodiments, the number of the coarse precipitates was larger than the range of the disclosed embodiments. Furthermore, the average cross-sectional area of the coarse precipitates was larger than the range of the disclosed embodiments. Thus, the hydrogen embrittlement resistance was poor.

In the comparative example of test No. 2-19, because the Nb content was higher than the composition range of the disclosed embodiments, the average cross-sectional area of the coarse precipitates was larger than the range of the disclosed embodiments. Thus, the hydrogen embrittlement resistance was poor.

In the comparative example of test No. 2-20, because the Al content was higher than the composition range of the disclosed embodiments, the number of the coarse precipitates was larger than the range of the disclosed embodiments. Thus, the hydrogen embrittlement resistance was poor.

In the comparative example of test No. 2-21, because the Al content was lower than the composition range of the disclosed embodiments, the average cross-sectional area of the coarse precipitates was larger than the range of the disclosed embodiments. Thus, the hydrogen embrittlement resistance was poor.

In the comparative example of test No. 2-22, because the O content was higher than the composition range of the disclosed embodiments, the number of the coarse precipitates was larger than the range of the disclosed embodiments. Thus, the hydrogen embrittlement resistance was poor.

In the comparative example of test No. 2-23, because the O content was lower than the composition range of the disclosed embodiments, the average cross-sectional area of the coarse precipitates was larger than the range of the disclosed embodiments. Thus, the hydrogen embrittlement resistance was poor.

In the comparative example of test No. 2-24, because the Cr content was lower than the composition range of the disclosed embodiments, the corrosion resistance was poor.

INDUSTRIAL APPLICABILITY

The steel sheet according to the disclosed embodiments has excellent corrosion resistance and excellent hydrogen embrittlement resistance and thus is suitable for processed members, such as muffler cutters, lockers, components for home appliances, automobile exhaust pipes, building materials, drainage covers, containers for marine transportation, kitchen appliances, building exterior materials, railroad vehicles, outer panels of electrical device housings, pipes for water, and water storage tanks, exposed to hydrogen penetration environments.

The invention claimed is:

1. A ferritic stainless steel sheet, comprising:

a chemical composition comprising, by mass percent:

C: 0.001% to 0.020%,

Si: 0.10% to 0.60%,

Mn: 0.10% to 0.60%,

P: 0.040% or less,

S: 0.030% or less,

Al: 0.030% to 0.060%,

Cr: 16.5% to 19.0%,

Ti: 0.15% to 0.35%

Nb: 0.30% to 0.60%,

Ni: 0.01% to 0.60%,

O (oxygen): 0.0025% to 0.0050%, and

N: 0.001% to 0.020%, the balance being Fe and incidental impurities, wherein a number of precipitates having a cross-sectional area of 5.0 $\mu m^2$ or more is 300 or less in a 1-$mm^2$ region, and the precipitates having a cross-sectional area of 5.0 $\mu m^2$ or more have an average cross-sectional area of 20.0 $\mu m^2$ or less.

2. The ferritic stainless steel sheet according to claim 1, wherein the chemical composition further comprises, by mass percent, at least one selected from the group consisting of:

Cu: 0.01% to 0.80%,

Co: 0.01% to 0.50%,

Mo: 0.01% to 1.00%,

W: 0.01% to 0.50%,

V: 0.01% to 0.50%, and

Zr: 0.01% to 0.50%.

3. The ferritic stainless steel sheet according to claim 1, wherein the chemical composition further comprises, by mass percent, at least one selected from the group consisting of:

B: 0.0003% to 0.0030%,

Mg: 0.0005% to 0.0100%,

Ca: 0.0003% to 0.0030%,

Y: 0.01% to 0.20%, rare-earth metals (REMs): 0.01% to 0.10%,

Sn: 0.01% to 0.50%, and

Sb: 0.01% to 0.50%.

4. The ferritic stainless steel sheet according to claim 1, wherein an elongation after fracture A (%) of the steel sheet when the steel sheet contains a concentration of 0.30 to 0.60 mass ppm hydrogen and an elongation after fracture B (%) of the steel sheet when the steel sheet contains a concentration of 0.02 mass ppm or less hydrogen satisfy formula (1):

$$\text{Elongation after fracture } B\ (\%) - \text{elongation after fracture } A\ (\%) \leq 5(\%) \qquad \text{formula (1).}$$

5. The ferritic stainless steel sheet according to claim 2, wherein the chemical composition further comprises, by mass percent, at least one selected from the group consisting of:

B: 0.0003% to 0.0030%,

Mg: 0.0005% to 0.0100%,

Ca: 0.0003% to 0.0030%,

Y: 0.01% to 0.20%, rare-earth metals (REMs): 0.01% to 0.10%,

Sn: 0.01% to 0.50%, and

Sb: 0.01% to 0.50%.

6. The ferritic stainless steel sheet according to claim 2, wherein an elongation after fracture A (%) of the steel sheet when the steel sheet contains a concentration of 0.30 to 0.60 mass ppm hydrogen and an elongation after fracture B (%)

of the steel sheet when the steel sheet contains a concentration of 0.02 mass ppm or less hydrogen satisfy formula (1):

Elongation after fracture $B$ (%)−elongation after fracture $A$ (%)≤5(%) formula (1).

7. The ferritic stainless steel sheet according to claim 3, wherein an elongation after fracture A (%) of the steel sheet when the steel sheet contains a concentration of 0.30 to 0.60 mass ppm hydrogen and an elongation after fracture B (%) of the steel sheet when the steel sheet contains a concentration of 0.02 mass ppm or less hydrogen satisfy formula (1):

Elongation after fracture $B$ (%)−elongation after fracture $A$ (%)≤5(%) formula (1).

8. The ferritic stainless steel sheet according to claim 5, wherein an elongation after fracture A (%) of the steel sheet when the steel sheet contains a concentration of 0.30 to 0.60 mass ppm hydrogen and an elongation after fracture B (%) of the steel sheet when the steel sheet contains a concentration of 0.02 mass ppm or less hydrogen satisfy formula (1):

Elongation after fracture $B$ (%)−elongation after fracture $A$ (%)≤5(%) formula (1).

9. The ferritic stainless steel sheet according to claim 1, wherein a number of precipitates having a cross-sectional area of 5.0 $\mu m^2$ or more is 200 or less in a 1-$mm^2$ region.

10. The ferritic stainless steel sheet according to claim 1, wherein the precipitates having a cross-sectional area of 5.0 $\mu m^2$ or more have an average cross-sectional area of 15.0 $\mu m^2$ or less.

11. A method for manufacturing the ferritic stainless steel sheet according to claim 1, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

12. A method for manufacturing the ferritic stainless steel sheet according to claim 2, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

13. A method for manufacturing the ferritic stainless steel sheet according to claim 3, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

14. A method for manufacturing the ferritic stainless steel sheet according to claim 4, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

15. A method for manufacturing the ferritic stainless steel sheet according to claim 6, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

16. A method for manufacturing the ferritic stainless steel sheet according to claim 6, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

17. A method for manufacturing the ferritic stainless steel sheet according to claim 7, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

18. A method for manufacturing the ferritic stainless steel sheet according to claim 8, the method comprising:

hot-rolling a steel slab having the chemical composition into a hot-rolled steel sheet;

annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,000° C. or higher and 1,060° C. or lower for 5 to 180 seconds.

19. A method for manufacturing the ferritic stainless steel sheet according to claim 1, the method comprising:

hot-rolling a steel slab having the chemical composition into a hot-rolled steel sheet; annealing the hot-rolled steel sheet into a hot-rolled and annealed steel sheet by holding the hot-rolled steel sheet at 940° C. or higher and 980° C. or lower for 5 to 180 seconds;

cold-rolling the hot-rolled and annealed steel sheet into a cold-rolled steel sheet; and annealing the cold-rolled steel sheet by holding the cold-rolled steel sheet at 1,030° C. or higher and 1,060° C. or lower for 5 to 180 seconds.

* * * * *